US010781556B2

(12) United States Patent
Hietaniemi et al.

(10) Patent No.: US 10,781,556 B2
(45) Date of Patent: Sep. 22, 2020

(54) DRY STRENGTH COMPOSITION, ITS USE AND METHOD FOR MAKING OF PAPER, BOARD OR THE LIKE

(71) Applicant: Kemira Oyj, Helsinki (FI)

(72) Inventors: Matti Hietaniemi, Espoo (FI); Asko Karppi, Turku (FI); Mikko Virtanen, Helsinki (FI)

(73) Assignee: Kemira Oyj, Helsinki (FI)

( * ) Notice: Subject to any disclaimer, the term of this patent is extended or adjusted under 35 U.S.C. 154(b) by 45 days.

(21) Appl. No.: 16/319,362

(22) PCT Filed: Sep. 26, 2017

(86) PCT No.: PCT/FI2017/050674
§ 371 (c)(1),
(2) Date: Jan. 21, 2019

(87) PCT Pub. No.: WO2018/055239
PCT Pub. Date: Mar. 29, 2018

(65) Prior Publication Data

US 2019/0242065 A1 Aug. 8, 2019

(30) Foreign Application Priority Data

Sep. 26, 2016 (FI) ..... 20165718

(51) Int. Cl.

| | |
|---|---|
| ***D21H 21/18*** | (2006.01) |
| ***D21H 17/29*** | (2006.01) |
| ***D21H 17/43*** | (2006.01) |
| ***D21H 17/00*** | (2006.01) |
| ***D21H 23/10*** | (2006.01) |
| ***D21H 17/37*** | (2006.01) |
| ***D21H 21/10*** | (2006.01) |

(52) U.S. Cl.
CPC ..... *D21H 21/18* (2013.01); *D21H 17/29* (2013.01); *D21H 17/375* (2013.01); *D21H 17/43* (2013.01); *D21H 17/71* (2013.01); *D21H 17/72* (2013.01); *D21H 21/10* (2013.01); *D21H 23/10* (2013.01)

(58) Field of Classification Search
None
See application file for complete search history.

(56) References Cited

U.S. PATENT DOCUMENTS

| | | | | |
|---|---|---|---|---|
| 4,750,974 | A * | 6/1988 | Johnson | D21H 17/29 162/164.1 |
| 2003/0188840 | A1 | 10/2003 | Van Handel et al. | |
| 2011/0256085 | A1* | 10/2011 | Talingting Pabalan | C08L 5/00 424/70.13 |
| 2012/0118523 | A1 | 5/2012 | Lu et al. | |
| 2016/0289896 | A1* | 10/2016 | Hietaniemi | D21H 17/29 |

FOREIGN PATENT DOCUMENTS

| | | | |
|---|---|---|---|
| EP | 0234513 | A1 | 9/1987 |
| EP | 2917406 | A1 | 9/2015 |
| JP | 2007277795 | A | 10/2007 |
| WO | 2017149200 | A1 | 9/2017 |

OTHER PUBLICATIONS

Finnish Patent Office, Search report of FI20165718, dated Apr. 10, 2017.

* cited by examiner

*Primary Examiner* — Dennis R Cordray
(74) *Attorney, Agent, or Firm* — Berggren LLP

(57) ABSTRACT

The invention relates to an aqueous dry strength composition suitable for use in manufacture of paper, board or the like. The composition includes a mixture of a synthetic polymer component, which is a copolymer of acrylamide and at least one anionic monomer, and a cationic starch component. The polymer component has an anionicity of 1-60 mol-%. The synthetic polymer component and cationic starch component provide the composition with a charge density in the range of 0.05-1 meq/g, when measured at pH 2.8, and 0.2--3 meq/g, when measured at pH 7.0. The invention also relates to a method for making of paper, board or the like, where the dry strength composition is diluted with water, and the solution of the dry strength composition is added to the fibre stock before or after the addition of a cationic strength agent.

21 Claims, No Drawings

DRY STRENGTH COMPOSITION, ITS USE AND METHOD FOR MAKING OF PAPER, BOARD OR THE LIKE

This application is a U.S national application of the international application number PCT/F12017/050674 filed on Sep. 26, 2017 and claiming priority of Finnish national application 20165718 filed on Sep. 26, 2016 the contents of all of which are incorporated herein by reference.

The present invention relates to a dry strength composition and its use, as well as to a method for making of paper, board or the like according to the preambles of the enclosed independent claims.

In manufacture of paper or board the properties of the fibre stock as well as the final paper are modified by adding various chemicals to the fibre stock before the formation of the paper or board web. A property, often desired for the final paper or board, is the dry strength. Synthetic polymers, either anionic or cationic, are commonly used in papermaking to increase, for example, the dry strength properties of the final paper or board. These polymers are added to the fibre stock where they interact with the components of the stock, e.g. fibres and/or fillers.

The conventional ways to increase the dry strength properties of paper have, however, their drawbacks. Especially, they are not optimal when making of paper or board with high filler content. For example, it has been observed that synthetic polymers have their limitations when they are used as dry strength agents. Anionic polymers are often added together with a cationic component. As the fibre surface is also anionic, the cationic component is consumed both by fibre surfaces and by the anionic polymer. The problem becomes more pronounced if the pulp contains high amounts of anionic trash, i.e. has high cationic demand. For practical reasons, such as overall process economy, the dosage of cationic component to the fibre stock cannot be added ad infinitum. As the dosage of the cationic component has practical limitations, also the dosage of the anionic polymer is thus in practice limited to a level, which does not necessarily provide a sufficient increase in dry strength properties. Any further increase in dosage of the anionic component would only increase anionic content in circulating process water and possibly lead other process problems due to excess anionic charges.

A further significant challenge for conventional dry strength systems comprising cationic and anionic polymers is the conductivity of the fibre stock. When the conductivity of the fibre stock is high, the ionic bonds to be formed between the polymer components are disturbed and replaced by salt formation. High conductivity of the fibre stock may also cause compression of the three-dimensional structure of polymer and change the polymer performance. Paper and board making processes which are operated with low fresh water consumption, i.e. closed water circulations, often have high conductivity.

There is a constant need to find new effective substances or compositions, which could be used to increase the dry strength properties of the produced paper and board. Further, there is continuing desire to increase the amount of fillers in the stock, as well as desire to use recycled fibres with lower strength characteristics. The used chemicals should also be cost effective, easy to transport and store. The formed fibre web should also be easy to dewater in the successive process steps after web formation, e.g. press section.

An object of this invention is to minimise or even eliminate the disadvantages existing in the prior art.

An object is also to provide a dry strength composition and a method which provide effective increase in dry strength properties of the final paper or board, as well as effective dewatering of the web, especially at the press section of a paper or board machine.

A further object of this invention is to provide a dry strength composition and a method which are also suitable for fibre stocks having a high cationic demand.

A yet further object of this invention is to provide a dry strength composition and a method which are also suitable for fibre stocks having a high conductivity.

These objects are attained with the invention having the characteristics presented below in the characterising parts of the independent claims. Some preferable embodiments are disclosed in the dependent claims.

The embodiments mentioned in this text relate, where applicable, to all aspects of the invention, even if this is not always separately mentioned.

A typical aqueous dry strength composition according to the present invention which is suitable for use in manufacture of paper, board or the like comprises a mixture of

- a synthetic polymer component, which is a copolymer of acrylamide and at least one anionic monomer, the polymer component having an anionicity of 1-60 mol-%, and
- a cationic starch component, the synthetic polymer component and cationic starch component providing the composition with a charge density in the range of 0.05-1 meq/g, when measured at pH 2.8, and −0.2--3 meq/g, when measured at pH 7.0.

Typical use of a dry strength composition according to the present invention is for improving strength properties of a paper, board or the like.

A typical method according to the present invention for making of paper, board or the like, especially for increasing the strength properties of paper, board or the like, where the method comprises

- obtaining a fibre stock having a pH value,
- adding a cationic strength agent to the fibre stock, and
- diluting a dry strength composition according to the invention with water to obtain a solution of dry strength composition having an end pH >3, and preferably viscosity of at most 6 000 mPas, at dry solids content of <10 weight-%, preferably <5 weight-%, more preferably 0.5-4.5 weight-%, and
- adding the solution of the dry strength composition to the fibre stock before or after the addition of the cationic strength agent.

Now it has been surprisingly found out that an effective increase in dry strength properties can be achieved when using a dry strength composition comprising both a synthetic polymer component and a cationic starch component. Without wishing to be bound by a theory, it is assumed that the cationic starch component provides a long-reaching three-dimensional network which interacts with the fibres and filler particles in the fibre stock. The starch component may be considered to act like a "carrier" or "polyionic cross-linker" for the synthetic polymeric component. The interaction of the starch component and the polymer component results a structure that can be seen as polyionic complex. The starch component forms hydrogen bonds and thus improves the strength effect originating from ionic bonds formed with the synthetic polymer component. The synthetic polymer component shows improved retention to the fibre web due to the three-dimensional network provided by the cationic starch component. This leads to better dry strength effect obtainable with the same amount of added synthetic polymer.

The dry strength composition according to the present invention comprises both anionic groups mainly originating from the synthetic polymer component as well as cationic groups mainly originating from the starch component. The net charge of the dry strength composition is carefully selected to provide optimal behaviour at different pH values encountered during preparation, storage and/or transport of composition as well as usage of the composition.

When the dry strength composition according to the present invention is used together with a conventional cationic strength agent, the dry strength composition is able form a high number of bonds with the cationic strength agent due to its polyionic nature, as explained above. At the stock pH the dry strength composition shows a high number of anionic charges capable of interacting with the cationic strength agent, typically cationic strength polymer. Thus the dry strength composition can interact effectively with the cationic strength agent also under high shear and/or in fibre stock having high cationic demand and/or high conductivity. The end pH denotes the pH of the dry strength composition, which it has at the time of addition to the fibre stock.

Furthermore, it has been observed that the use of the dry strength composition according to the present invention increases and improves the dewatering of the fibre web, especially at the press section. This means that it is possible to achieve fibre web with a high dry content after the press section, which reduces the need for drying in the actual drying section. This consequently reduces the energy needed for the drying of the web to the final dry content.

According to one embodiment of the invention the synthetic polymer component and cationic starch component provide the dry strength composition with a charge density in the range of 0.1-0.5 meq/g, preferably 0.15-0.3 meq/g, when measured at pH 2.8, and −0.4--2.0 meq/g, preferably −0.5--1.5, when measured at pH 7.0. According to one embodiment of the invention the dry strength composition may have a charge density of −0.3--3.0 meq/g, preferably −0.4--3.0 meq/g, more preferably −0.5--3.0 meq/g, when measured at pH 7.0. The defined charge density at pH <3.5 is suitable to provide easy handling of the composition, and at pH >3.5 the charge density is sufficient to ensure the presence of anionic charges in order to provide an effective interaction both with starch component as well as the fibres and fillers in the stock and to obtain optimal strength effect.

According to one preferred embodiment the dry strength composition has anionic net charge already at pH 5.5, preferably already at pH 5.0, more preferably already at pH 4.5.

When the pH value of the composition is <3.5 the charge density of the dry strength composition originates mainly from the cationically charged groups of the cationic starch component. The charge density of dry strength composition at pH values >3.5 originates mainly from the anionically charged groups of the synthetic polymer component. The synthetic polymer component may have a charge density of −0.3--7 meq/g, preferably −0.5--5 meq/g, more preferably −1--3 meq/g, even more preferably −1--2 meq/g, at pH 7, i.e. it is anionic at pH 7.

According to one embodiment of the dry strength composition may have a pH value <3.5 and a dry solids content in the range of 5-30 weight-%, preferably 10-20 weight-%, more preferably 12-17 weight-% during its manufacture, transport and/or storage. At acidic pH values <3.5 the anionic groups of the polymer component are in acid form. When the pH value decreases, the interaction between the anionic groups of the synthetic polymer component and the cationic starch component decreases. For example at pH values <3.2 anionic groups of the synthetic polymer component are almost free or completely free from interaction with the charged cationic starch component. This provides a low viscosity for easy preparation and handling of the composition, even at high solids content. The high solids content of the composition is economical in view of storage and transport, as the same amount of active components requires less space. The pH of the composition may be adjusted to a value <3.5 by addition of an acid.

When the dry strength composition is ready for addition to the fibre stock, it is diluted with water and it may have an end pH value in the range of 3.8-6.0, preferably 4-5.5, and a dry solids content of <10 weight-%, preferably <5 weight-%, more preferably 0.5-4.5 weight-% after the dilution. Typically the strength composition may show both cationic and anionic charges at the end pH, i.e. at the pH of addition. The defined charge density at pH >3.5 is sufficient to provide an effective interaction both with starch component as well as the fibres and/or fillers in the stock and to obtain optimal strength effect. Furthermore, it has been observed that when the dry strength composition has a solids content <10 weight-% it may be effectively mixed with the stock in the wet-end of a paper or board machine. The solids content of <5% is especially preferable when the starch component comprises non-degraded starch.

After the addition to the fibre stock the dry strength composition comes into an environment where the charged groups of the dry strength composition are mainly anionic. This means that at the fibre stock pH the dry strength composition is net anionic.

According to one embodiment of the invention the dry strength composition comprises 10-90 weight-%, preferably 30-70 weight-%, more preferably 40-60 weight-%, of the synthetic polymer component, and 10-90 weight-%, preferably 30-70 weight-%, more preferably 40-60 weight-% of the cationic starch component, calculated from the dry weight of the composition. According to one preferable embodiment of the invention the ratio of the synthetic polymer component to the cationic starch component is 40:60-60:40, given as dry weights. The ratio of the synthetic polymer to the cationic starch component is chosen so that the dry strength composition is net anionic at the pH of the fibre stock.

The dry strength composition comprises a synthetic polymer component, which may be a copolymer of acrylamide and at least one anionic monomer. The copolymer may be linear or crosslinked. The synthetic polymer may be prepared by any suitable polymerisation method, such as solution polymerisation, dispersion polymerisation, emulsion polymerisation, gel polymerisation or bead polymerisation. According to one embodiment of the invention the synthetic polymer component of the dry strength composition is prepared by polymerisation of acrylamide and at least one anionic monomer, which is selected from unsaturated mono- or dicarboxylic acids or their salts, such as acrylic acid, methacrylic acid, maleic acid, itaconic acid, crotonic acid, isocrotonic acid, and any of their mixtures. Preferably, the synthetic polymer component is prepared by solution polymerisation of acrylamide and acrylic acid.

In case the synthetic polymer component is crosslinked, a cross-linker is used in the polymerisation in amount of 100-1000 mg/kg monomers, preferably 100-500 mg/kg monomers. Suitable cross-linkers are, for example, methylenebisacryl-amide, ethylene glycol divinyl ether, di(ethylene glycol) divinyl ether, tri(ethylene glycol) divinyl ether, methylenebisacrylamide being preferred.

According to one embodiment the synthetic polymer component is non-crosslinked or only slightly crosslinked by using a cross-linker in the polymerisation in amount of 0.25-100 mg/kg monomers, preferably 0.5-10 mg/kg monomers. preferably 0.75-5 mg/kg monomers.

The synthetic polymer component may have an anionicity of 3-40 mol-%, preferably 5-18 mol-%, more preferably 9-15 mol-%. The anionicity relates to the amount of structural units in the synthetic polymer component which originate from anionic monomers. Anionicity of the synthetic polymer component is selected to optimise the binding of the dry strength composition to the fibres, fillers and/or optional other constituents in the stock and thus the dry strength effect which is obtained. In case the amount of units originating from anionic monomers is too low, the dry strength composition does no show the desired anionic net charge, whereby the desired binding and strength effect is not obtained. On the other hand, if the amount of units originating from anionic monomers is too high, the dosage needed is too small to induce the desired strength effect. In the latter case, an increase in dosage only leads to increase in anionic content circulating process water.

According to one embodiment of the invention the synthetic polymer component, preferably prepared by solution polymerisation, may have a weight average molecular weight, MW, >300 000 g/mol, preferably >500 000 g/mol. Preferably the weight average molecular weight of the synthetic polymer component may be in the range of 300 000-1 000 000 g/mol, more preferably 400 000-1 000 000 g/mol, even more preferably 500 000-900 000 g/mol. The average molecular weight of the synthetic polymer component is carefully selected in order to provide optimal function in the dry strength composition. It has been observed that in case the average molecular weight is too high, the viscosity of the dry strength composition becomes easily too high at useful solid content, or the solid content becomes too low if useful viscosity is desired. Too low average molecular weight reduces the strength effect obtainable.

According to another embodiment the synthetic polymer component is obtained by adiabatic gel polymerisation followed by drying, by bead polymerisation in a solvent or by emulsion polymerisation or dispersion polymerisation in aqueous salt medium and has an average molecular weight MW in the range of 2 000 000-18 000 000 g/mol, preferably 4 000 000-10 000 000 g/mol.

In this application the value "average molecular weight" is used to describe the magnitude of the polymer chain length and it indicates the weight average molecular weight of the polymer. Average molecular weight values are calculated from intrinsic viscosity results measured in a known manner in 1N NaCl at 25° C. by using an Ubbelohde capillary viscometer. The capillary selected is appropriate, and in the measurements of this application an Ubbelohde capillary viscometer with constant K=0.005228 was used. The average molecular weight is then calculated from intrinsic viscosity result in a known manner using Mark-Houwink equation $[\eta]=K\cdot M^{a}$, where $[\eta]$ is intrinsic viscosity, M molecular weight (g/mol), and K and a are parameters given in Polymer Handbook, Fourth Edition, Volume 2, Editors: J. Brandrup, E. H. Immergut and E. A. Grulke, John Wiley & Sons, Inc., USA, 1999, p. VII/11 for poly(acrylamide). Accordingly, value of parameter K is 0.0191 ml/g and value of parameter a is 0.71. The average molecular weight range given for the parameters in used conditions is 490 000-3 200 000 g/mol, but the same parameters are used to describe the magnitude of molecular weight also outside this range. For polymers having a low average molecular weight, typically around 1 000 000 g/mol or less, the average molecular weight is measured by using Brookfield viscosity measurement at 10% polymer concentration at 23° C. temperature. Molecular weight [g/mol] is calculated from formula 1000 000*0.77*ln(viscosity[mPas]). In practice this means that for polymers which the Brookfield viscosity can be measured and the calculated value is less than <1 000 000 g/mol, the calculated value is the accepted MW value. If the Brookfield viscosity cannot be measured or the calculated value is over 1 000 000 g/mol, the MW values are determined by using intrinsic viscosity as described above.

The dry strength composition comprises, in addition to synthetic polymer component, a cationic starch component, which is of natural origin. According to one preferable embodiment the cationic starch component is cationic non-degraded starch. In the present context this means starch, which has been modified solely by cationisation, and which is non-degraded and non-cross-linked. According to one embodiment of the invention the cationic starch component comprises starch units of which at least 70 weight-%, preferably at least 80 weight-%, more preferably at least 85 weight-%, even more preferably at least 90 weight-%, sometimes even more preferably at least 95 weight-%, have an average molecular weight MW over 20 000 000 g/mol, preferably over 50 000 000 g/mol, more preferably over 100 000 000 g/mol, sometimes even over 200 000 000 g/mol. When the cationic starch component is non-degraded, the length of the starch molecules provides successful three-dimensional network effect, and an optimal interaction with the synthetic polymer component as well as with other constituents of the fibre stock, e.g. fibres and/or inorganic fillers, as well as cationic strength agents that has been separately added to the fibre stock.

The cationic starch component may be potato, waxy potato, rice, corn, waxy corn, wheat, barley, sweet potato or tapioca starch. Preferably the cationic starch component is waxy corn starch and waxy potato starch. According to one preferable embodiment the cationic starch component has an amylopectin content >70%, preferably >80%, more preferably >85, even more preferably >90%, sometimes even more preferably >95%.

The cationic starch component is in form of an aqueous solution, which means that the starch has been dissolved in water, e.g. by cooking. The cooking may be performed at temperature of 60-135° C.

Starch may be cationised by any suitable method. Preferably starch is cationised by using 2,3-epoxypropyltrimethylammonium chloride or 3-chloro-2-hydroxypropyltrimethylammonium chloride, 2,3-epoxypropyltrimethylammonium chloride being preferred. It is also possible to cationise starch by using cationic acrylamide derivatives, such as (3-acrylamidopropyl)-trimethylammonium chloride.

The cationic starch component may have a substitution degree of 0.025-0.3, preferably 0.03-0.16, more preferably 0.045-0.1. The substitution degree is relative to the cationicity of the starch. Cationic starches having relatively high cationicity as defined are preferred for use in the dry strength composition as they provide the improved dry strength effect, which is observed in the final paper or board.

According to one preferable embodiment the dry strength composition is free of cationic synthetic polymers.

The dry strength composition is a mixture of a synthetic polymer component and a cationic starch component. The components of the dry strength composition may be mixed with each other before the addition of the composition to the fibre stock, i.e. the composition is added to the stock as a single solution. In the present context mixture of a synthetic polymer component and a cationic starch component is understood as a blend or combination of an existing synthetic polymer component and a starch component. Both components are in form of a solution or dispersion at the time of mixing. In other words, a mixture is not to be interpreted to cover compositions obtained by polymerising monomers of a synthetic polymer in the presence of a cationic starch component thereby forming starch grafts.

According to one embodiment the dry strength composition according to the present invention can be prepared by effective mixing of the starch component into a solution of synthetic polymer component, preferably at pH <3.5. If the pH is higher than 4.5 at the mixing, there may be a risk for gel formation, especially if the solids content of the composition is >12 weight-%.

The synthetic polymer component may be in form of an aqueous solution or dispersion when it is mixed with the starch component.

According to another embodiment solutions of starch component and the polymer component, which both have solids concentration <12 weight-%, preferably <10 weight-%, may be mixed with each other before the addition to the stock.

Preferably the starch component and the synthetic polymer component are allowed to interact with each other before the dry strength composition is added to the fibre stock in order to guarantee the formation of the polyionic complex.

In principle, the components of the dry strength composition may be added separately, either simultaneously or sequentially, to a flow which is later combined with the thick stock, as long as the time between the addition of the last component and the combination with the thick stock is long enough to provide the desired interaction of the components.

According to one embodiment of the invention the dry strength composition may be prepared on-site. This means that the synthetic polymer component and the cationic starch component may be transported separately, even as dry products, to the site of use, such as paper mill or board mill. At the site of use the synthetic polymer component and the cationic starch component are optionally dissolved and/or diluted and prepared into the aqueous dry strength composition by mixing. This reduces the risk of degradation of the dry strength composition during transportation and storage. Especially the cationic starch component may be vulnerable to microbiological degradation, which could lead to loss of performance.

The dry strength composition according to the present invention has a pH value <3.5, preferably <3, when it is prepared or stored as a storage solution with high solids content, for example >10 weight-%. It has been observed that the low pH improves the mixing of the synthetic anionic polymer component to the cationic starch component and provides homogenous dry strength composition with desired viscosity. According to one preferable embodiment the dry strength composition has a Brookfield viscosity of <10 000 mPas, preferably <8000 mPas, more preferably <6000 mPas, at pH 3.0 and at solids content of 14 weight-%. According to one embodiment the viscosity of the dry strength composition is in the range of 2000-10 000 mPas, preferably 2500-6500 mPas, at pH 3.0 and at solids content of 14 weight-%. The viscosity values are measured at room temperature by using Brookfield DV-I+, small sample adapter, 20 spindle 31, maximum rpm. The viscosity of the dry strength composition at high solids content at pH <3.5 is suitable for proper handling of the composition in an industrial process, for example, enabling pumping of the composition and its dilution by mixing.

In general the dry strength composition has an anionic net charge from pH value about 3.8 upwards. Polyionic complex, which results from the interaction of the starch component and the synthetic polymer component, may be formed already in great extent at pH about 3.2. When the dry strength composition having a pH value <3.5 and a high solids content, e.g. >10 weight-%, is diluted with water, the pH of the composition changes simultaneously with the added water. Alternatively, the pH of the composition may be adjusted by addition of a base. The dry strength composition is normally diluted with water and the pH is adjusted, either by dilution or by addition of base, to obtain a composition solution, which has pH value >3, preferably at least 3.5, more preferably 3.5-4.0, before the addition of the dry strength composition to the fibre stock. When the pH of the dry strength composition exceeds pH 5, the net charge of the composition is anionic. At pH 7 the dry strength composition has always anionic net charge.

The dry strength composition may be added to either thick stock or thin stock, preferably to thick stock. Thick stock is here understood as fibre stock having consistency >2.5 weight-%, preferably >3 weight-%.

The dry strength composition according to the present invention interacts with the cationic strength agent e.g. by forming complexes and/or covalent bonds. This increases the amount and strength of the bonds between the different constituents of the stock, i.e. fibres, fillers, fines, trash, chemicals, etc. The increase in interaction improves the observed dry strength in unexpected degree. The dry strength composition is added before or after, preferably after, the addition of the cationic strength agent. The cationic strength agent and the individual components of the dry strength components may be same or different from each other. When a cationic strength agent is added first to the stock, the risk for unwanted strong flocculation at the addition of the dry strength composition is reduced.

The dry strength composition and the cationic strength agent are added separately to the fibre stock.

The cationic strength agent may be selected from a group comprising of cationic starch and synthetic polymers, such as polyamidoamine-epichlorohydrin, cationic polymers of acrylamide, and polyvinylamines. Polyvinylamines include partially or completely hydrolysed homopolymers of N-vinylformamide, partially or completely hydrolysed copolymers of N-vinylformamide and acrylic acid, as well as partially or completely hydrolysed copolymers of vinylacetate and N-vinylformamide.

According to one embodiment the cationic strength agent may be cationic starch, which is preferably of identical botanic origin as the cationic starch component of the dry the strength composition. When the cationic starch component and cationic strength agent are of same botanic origin, preferably identical, no additional storage vessels for different grades of cationic starch are needed.

The cationic strength agent may be added in amount of 0.5-3 kg/ton dry stock, when a synthetic polymer, such as polyamidoamine-epichlorohydrin, a cationic polymer of acrylamide, or a polyvinylamine, is used as cationic strength agent. The cationic strength agent may be added in amount of 3-20 kg/ton dry stock, preferably 10-18 kg/ton dry stock, especially when cationic starch is used as cationic strength agent.

The dry strength composition may be added in amount of 0.5-4.0 kg/ton dry fibre stock, preferably 0.5-3.5 kg/ton dry fibre stock, more preferably 1-3 kg/ton dry fibre stock. According to one embodiment of the invention the dry strength composition is added in such amount that zeta potential of the fibre stock is decreased by 2-20 mV, preferably 3-10 mV, measured after addition of the dry strength composition and when compared to the zeta potential value of the fibre stock immediately before the addition.

According to one embodiment of the invention the cationic strength agent and the dry strength composition are added in the fibre stock in such amount that the number of excess anionic charges in the dry strength composition, at pH 7, is 20-200%, preferably 50-120%, of the total number of cationic charges of the cationic strength agent at the same pH. The number of excess anionic charges is calculated by subtracting the number of cationic charges in the dry strength composition from the number of anionic charges in the dry strength composition, at pH 7. In other words, when the number of excess anionic charges in the dry strength composition, at pH 7, is 100% of the number of the cationic charges in the cationic strength agent, it means that there is one excess anionic charge from the dry strength composition for every cationic charge from the cationic strength agent. In this manner an optimal interaction between the cationic strength agent and the dry strength composition can be ensured, when the charge ratio is as defined above.

The dry strength composition according to present invention is suitable for improving dry strength of the board web when producing paperboard like liner, fluting, folding boxboard (FBB), white lined chipboard (WLC), solid bleached sulphate (SBS) board, solid unbleached sulphate (SUS) board or liquid packaging board (LPB), but not limited to these. Boards may have grammage from 120 to 500 g/m$^2$.

The fibre stock may have a pH value at least 4.5, preferably at least 5, more preferably at least 5.5. The stock pH may be in the range of 4.5-9.5, 5-9 preferably 5.5-8.5. At this pH, when present in the fibre stock, the dry strength composition has an anionic net charge.

According to one embodiment of the invention the dry strength composition is especially used for fibre stock, which comprises recycled fibre pulp and/or chemical pulp. Recycled fibres in the sense of the present application thus preferably do not include broke. Irrespective of the origin of the fibres the fibre stock may have a conductivity of at least 1.5 mS/cm or at least 2 mS/cm, preferably at least 3 mS/cm, more preferably at least 4 mS/cm, sometimes even more than 5 mS/cm. According to one embodiment the conductivity of the fibre stock may be in a range of 2-20 mS/cm, preferably 3-20 mS/cm, more preferably 2-15 mS/cm, sometimes even 4-15 mS/cm.

Fibre stock, which may comprise recycled fibre pulp and/or chemical pulp, may have cationic demand of >400 μeqv/l.

The dry strength composition according to present invention is suitable for improving dry strength of tissue or fine paper.

The invention relates also to a chemical system for manufacture of paper or board, the system comprising a cationic strength agent, as defined in this application and a dry strength composition according to the present invention.

EXPERIMENTAL

Synthetic Polymer Component: General Description of the Synthesis

Anionic polyacrylamides used in dry strength compositions of the experimental section as synthetic polymer components were synthesised by radical polymerisation using the general procedure described in the following.

Prior to the polymerisation all monomers used, water, Na-salt of EDTA and sodium hydroxide were mixed in a monomer tank. This mixture is hereafter called "monomer mixture". Monomer mixture was purged with nitrogen gas for 15 min.

A catalyst solution was prepared in a catalyst tank by mixing water and ammonium persulphate. The catalyst solution was made less than 30 min before its use.

Water was added into a polymerisation reactor equipped with a mixer and a jacket for heating and cooling. The water was purged with nitrogen gas for 15 min. The water was heated to 100° C. Feeding of both the monomer mixture and the catalyst solution were started at the same time. Feed time for the monomer mixture was 90 min and feed time for the catalyst solution was 100 min. When the feed of catalyst solution was terminated, the mixing was continued for 45 min. The obtained aqueous polymer solution was cooled to 30° C. and removed from the polymerisation reactor.

The following characteristics were analysed from the obtained aqueous polymer solution. Dry solids content was analysed by using Mettler Toledo HR73, at 150° C. Viscosity was analysed by using Brookfield DVI+, equipped with small sample adapter, at 25° C., using spindle S18 for solutions with viscosity <500 mPas and spindle S31 for solutions with viscosity 500 mPas or higher, and using the highest feasible rotation speed for the spindle. pH of the solution was analysed by using a calibrated pH-meter.

Synthesis of Synthetic Polymer Component, AC13HM

The production of one specific anionic polyacrylamide polymer, AC13HM, is explained in the following in detail as an example of the synthesis of an anionic polyacrylamide, suitable for use as synthetic polymer component in a dry strength composition.

Prior to the start of the polymerisation the monomer mixture was prepared in a monomer tank by mixing 45.2 g of water; 200.5 g of acrylamide, 50% aqueous solution; 14.5 g of acrylic acid; 0.59 g of Na salt of EDTA, 39% aqueous solution; 8.1 g of sodium hydroxide, 50% aqueous solution. The monomer mixture was purged with nitrogen gas for 15 min. A catalyst solution was prepared in a catalyst tank by mixing 27 g of water and 0.088 g of ammonium persulphate. 440 g of water was added into a polymerisation reactor and purged with nitrogen gas for 15 min. The water was heated to 100° C. Feeding of both the monomer mixture and the catalyst solution to the polymerisation reactor was started at the same time. Feed time for the monomer mixture was 90 min and for the catalyst solution 100 min. When the feed of the catalyst solution was terminated, the mixing was continued for 45 min. The obtained polymer was cooled to 30° C. and then removed from the polymerisation reactor. The synthetic anionic polyacrylamide polymer had dry solids content of 15.1 weight-%, viscosity of 7030 mPas, weight average molecular weight MW ca. 0.7 Mg/mol and pH 5.2.

Preparation of Cationic Starch Component, Starch-A 97.6 g cationic waxy potato starch, Starch-A, dry content 82 weight-% (for other properties see Table 7), was sludged in 436 g of water in a reactor equipped with a jacket for heating, a condenser and agitator. Slurry was heated to 99° C. while agitating by 500 rpm and kept at that temperature for 45 min with agitation on. The formed starch solution, when cooled, had concentration of 15.8 weight-% and viscosity of 1400 mPas.

Preparation of Dry Strength Composition

A series of aqueous dry strength compositions were prepared using the following general procedure. Synthetic APAM polymer solution, e.g. AC13HM, as described above, and starch solution of cationic starch, e.g. Starch-A, as described above, were mixed for 60 min at 25° C. by 1000 rpm. For example, dry strength composition SP1 (see Table 1) was prepared by mixing 66.0 g of polymer solution AC13HM as described above and 63 g of Starch-A solution as described above.

Dry strength compositions with different proportions of synthetic polymer component and cationic starch component, different dry content and different pH value were prepared. Dry strength compositions with lower dry content were prepared by dilution with de-ionized water. Dry strength compositions with low pH were prepared by adjusting their pH to the desired target value by adding sulphuric acid 25 weight-%.

Dry strength compositions prepared and their properties are given in Table 1. The synthetic polymer component was AC13HM and the cationic starch component was Starch-A in the dry strength compositions of Table 1, except for dry strength composition SPmix88, where the synthetic polymer component was AC13HM and cationic starch component was Starch-1; and for dry strength compositions SP4, and SP5, where the synthetic polymer component was AC11HM and the cationic starch component was Starch-A; and for dry strength composition SP6, where the synthetic polymer was AC11LM and the cationic starch component was Starch-A. For details of chemicals, see Table 7. Viscosity values in Table 1 were measured by using Brookfield LV, DV1 SSA with maximum rpm and spindle instructed by equipment.

It can be seen from the results of Table 1 that when the pH of the dry strength composition is 3.7, the viscosity of the dry strength composition is lower than when the pH of the dry strength composition is 5.2. This indicates that the synthetic polymer component in the dry strength composition is complexed more strongly at pH 5.2, where the polymer component is more anionic. Higher proportion of the synthetic polymer component increases the viscosity of the dry strength composition. Viscosity of the dry strength compositions can be decreased by dilution with water.

TABLE 1

Dry strength compositions prepared.

| Dry Strength Composition | Viscosity (mPas) | pH | Charge at pH 7 (meq/g) | Charge at pH 2.8 (meq/g) | Dry solids (%) | Starch (w-%) | APAM (w-%) |
|---|---|---|---|---|---|---|---|
| SP1 | 7700 | 3.7 | −0.67 | 0.20 | 15.5 | 50 | 50 |
| SP2 | 11700 | 3.7 | −1.04 | 0.13 | 15.3 | 33 | 67 |
| SP3 | 9650 | 3.6 | −0.57 | 0.20 | 14.8 | 50 | 50 |
| SP1a | 28000 | 5.2 | −0.67 | 0.20 | 15.5 | 50 | 50 |
| SP1b | 13900 | 5.2 | −0.67 | 0.20 | 13.0 | 50 | 50 |
| SP1c | 4000 | 3.7 | −0.67 | 0.20 | 13.0 | 50 | 50 |
| SP2a | 35200 | 5.2 | −1.04 | 0.13 | 15.3 | 33 | 67 |
| SP2b | 11700 | 3.7 | −1.04 | 0.13 | 15.3 | 33 | 67 |
| SP2c | NA | 5.5 | −1.04 | 0.13 | 15.3 | 33 | 67 |
| SPmix88 | NA | 5.0 | −0.71 | 0.11 | 1.0 | 50 | 50 |
| SP4 | 4700 | 3.0 | −0.64 | 0.28 | 14.0 | 50 | 50 |
| SP5 | 3170 | 3.0 | −0.20 | 0.28 | 14.7 | 69 | 31 |
| SP6 | 3470 | 3.0 | −0.64 | 0.28 | 15.2 | 50 | 50 |

Impact of the charge density to characteristics of dry strength composition was studied by preparing a dry strength composition as follows. Synthetic polymer component AC11HM, see Table 7, and cooked cationic Starch-A, as described above, were dissolved each separately in deionized water. The obtained solutions were combined with equal dry weight-% of synthetic polymer component and cationic starch component. After mixing for 60 mins at room temperature a clear solution having solids content of 14.3 weight-% was obtained. pH of the solution was adjusted by 32 weight-% sulphuric acid or sodium hydroxide solution to a desired target value. Viscosities of the solutions were measured with Brookfield DV1+viscometer at different pH values. Viscosity results are given in Table 2.

Results of Table 2 show that viscosity increased as the function of pH. Viscosity increase is moderate between pH 2.8 and 3.5 as well as between pH 4.5 and 7. Viscosity increased significantly when pH increased from 3.5 to 4.5.

TABLE 2

Viscosity of the dry strength composition at 14 weight-% concentration as the function of pH.

| pH | Viscosity (mPas) |
|---|---|
| 2.8 | 5 239 |
| 3.5 | 6 670 |
| 3.9 | 9 100 |
| 4.5 | 14 600 |
| 5.0 | 16 850 |
| 7.0 | 17 050 |

Samples were diluted with deionized water for suitable concentration for measurements of indicative charge densities by titration with Mütek PCD 03, using polyethylene-sulphonate solution or poly-DADMAC solution as titrant. Results are given in Table 3.

TABLE 3

Indicative charge density values of the dry strength composition at 14% concentration as the function of pH.

| pH | Charge density (meq/g dry) | Appearance of dry strength composition |
|---|---|---|
| 2.8 | 0.32 | Clear transparent |
| 3.5 | 0.13 | Slightly cloudy |
| 3.8 | −0.02 | Cloudy |
| 4.5 | −0.20 | Cloudy |
| 5.0 | −0.34 | Slightly cloudy |
| 7.0 | −0.69 | Clear transparent |

Charge density results in Table 3 show that the net charge of the dry strength composition comprising a synthetic polymer component and a cationic starch component turns from cationic to anionic at pH about 3.7. This means that polyion complex is formed in great degree already at pH about 3.5, at which pH determined cationic charge has decreased by about 60%. At pH over 4.5 a large amount of the cationic charges are complexed by the anionic groups of the synthetic polymer component. Charge density results support the observations of viscosity results in Table 2 that polyion complex formation occurs between pH 3.5 and 5.

Application Examples 1-9

Technical performance of dry strength compositions and comparative reference products was tested with various pulp and sheet studies.

Pulps used in the application examples and their properties are given in Table 4.

Properties of pulps were characterized using devices and/or standard methods listed in Table 5. pH, turbidity, conductivity and charge were measured from the filtrate of gravity filtration through black ribbon filter paper.

The properties of produced paper sheets were measured by using sheet testing devices and standard methods listed in Table 6.

Chemicals used in the application examples are given in Table 7.

TABLE 4

Pulps used in the application examples.

| Property | Pulp, Ex. 1 | Pulp, Ex. 2 | CTMP, Ex. 3 | Broke, Ex. 3 | White Water, Ex. 3 | OCC Pulp, Ex. 4 | White Water, Ex. 4 |
|---|---|---|---|---|---|---|---|
| pH | 6.9 | 6.7 | 6.6 | 7.1 | 6.7 | 6.3 | 5.6 |
| Turbidity, NTU | 2 | 2 | 100 | 104 | 35.8 | 549 | 80 |
| Conductivity of filtrate, mS/cm | 1.1 | 1.1 | 1.9 | 2.4 | 2.0 | 4.7 | 4.1 |
| Cationic demand, μeqv/l | 20.7 | 9.6 | 185 | 48 | 33 | 0.0 | 0.0 |
| Zeta potential, mV | −26.3 | −20.7 | −19.2 | −11.7 | | −4.4 | |
| Consistency, g/l | 4.7 | 4.8 | 40.7 | 37.0 | 1.0 | 39 | 0.3 |

TABLE 5

Pulp characterization methods

| Property | Device/Standard |
|---|---|
| pH | Knick Portamess 911 |
| Turbidity (NTU) | WTW Turb 555IR |
| Conductivity (mS/cm) | Knick Portamess 911 |
| Charge (μekv/l) | Mütek PCD 03 |
| Zeta potential (mV) | Mütek SZP-06 |
| Consistency (g/l) | ISO 4119 |

TABLE 6

Sheet testing devices and standard methods used for produced paper sheets.

| Measurement | Device | Standard |
|---|---|---|
| Basis weight | Mettler Toledo | ISO 536 |
| Ash content, 525° C. | — | ISO 1762 |
| Scott bond | Huygen | Tappi T 569 |
| Z-directional tensile | Lorentzen & Wettre | ISO 15754 |
| Taber, bending stiffness | Lorentzen & Wettre | Tappi T 489 om-08 |
| Tensile strength, Elastic modulus | Lorentzen & Wettre | ISO 1924-3 |

TABLE 7

Chemicals used in the application examples.

| Name | Composition/Product, Manufacturer | Description |
|---|---|---|
| APAM-1 | Copolymer of acrylamide and 8 mol-% acrylic acid | MW ca. 0.5 Mg/mol |
| AC13HM | Copolymer of acrylamide and 12.5 mol-% acrylic acid | MW ca. 0.7 Mg/mol |
| AC11HM | Copolymer of acrylamide and 11 mol-% acrylic acid | MW ca. 0.7 Mg/mol |
| AC11LM | Copolymer of acrylamide and 11 mol-% acrylic acid | MW ca. 0.5 Mg/mol |
| APAM-E | Anionic polyacrylamide | Emulsion polymer dissolved at 0.8% concentration |
| Starch-A | Cationic amylopectin starch | 0.4 meq/g (DS 0.07) cationic, >95% amylopectin, cooked |
| Starch-1 | Cationic potato starch: Raisamyl 50021, Chemigate | 0.2 meq/g (DS 0.035), 80% amylopectin, cooked |
| Starch-2 | Cationic starch: C*Bond HR 35844, Cargill | cooked |
| SCPAM | Copolymer of acrylamide and 10 mol-% ADAM-Cl | Solution polymer, MW ca. 0.8 Mg/mol |
| CPAM | Copolymer of acrylamide and 10 mol-% ADAM-Cl | MW ca. 7 Mg/mol, dry polymer dissolved at 0.5% concentration |
| CPAM-2 | Copolymer of acrylamide and 10 mol-% ADAM-Cl | MW ca. 12 Mg/mol, dry polymer dissolved at 0.5% concentration |
| GPAM | Glyoxylated cationic polyacrylamide: FennoBond 3150, Kemira Oyj, Finland | Water solution |
| CMC | Carboxymethyl cellulose: Finnfix 300, CP Kelco | dissolved at 80° C. |
| pDADMAC | polyDADMAC | MW ca. 0.2 Mg/mol |
| Alum | Aluminium sulphate: ALG, Kemira Oyj, Finland | |
| GCC | Ground calcium carbonate: Hydrocarb 60, Omya | particle size distribution: 60% of particles < 2 μm |
| Silica | Colloidal silica: FennoSil 495, Kemira Oyj, Finland | |
| Silica-2 | Colloidal silica: FennoSil 442, Kemira Oyj, Finland | |
| c-PVOH | Polyvinylalcohol having 12 mol-% vinylamine groups and 88 mol-% vinylalcohol groups | MW ca. 0.1 Mg/mol |

Application Example 1

This example simulates preparation of tissue paper, fine paper, kraft paper or surface layer for multi-ply board.

Test fibre stock was a mixture of chemical hardwood pulp and softwood pulp. Chemical pulps were prepared in Valley Hollander. Hardwood (HW) pulp was bleached birch kraft pulp refined to 25° SR and softwood (SW) pulp was bleached pine kraft pulp refined to 25° SR. Pulps were mixed together in 75%/25% HW/SW ratio, diluted with deionized water containing NaCl addition to 1.5 mS/cm level. Properties of the obtained test fibre stock are given in Table 4.

In hand sheet preparation chemicals were added to the test fibre stock in a dynamic drainage jar under mixing with 1000 rpm. Cationic strength chemicals were diluted before dosing to 0.2% concentration. Anionic chemicals and retention chemicals were diluted to 0.05% concentration before dosing. The chemicals added and their addition times are given in Table 8. All chemical amounts are given as kg dry chemical per ton dry fibre stock.

Hand sheets having basis weight of 80 g/m$^2$ were formed by using Rapid Kothen sheet former with circulation water in accordance with ISO 5269-2:2012. The sheets were dried in vacuum dryers for 6 minutes at 92° C. and at 1000 mbar. Before testing the laboratory sheets were pre-conditioned for 24 h at 23° C. in 50% relative humidity, according to ISO 187. The measured tensile index and Scott bond values for the prepared hand sheets are given in Table 8.

It can be seen from Table 8 that Test 1-4, where the dry strength composition SP1 was used, produced improvement in tensile and Scott bond values compared to Test 1-2, where only cationic strength agents were used. Test 1-4 provided improvement also to Test 1-3, where a system with separate additions of cationic strength agents and anionic polymer APAM-1 was used. The dry strength composition SP1 thus produces favourable strength properties for this kind of use.

TABLE 8

Hand sheet tests of application example 1: chemical additions and measured results.

| Time | - 60 s SCPAM | - 60 s Starch-A | - 30 s APAM-1 | - 30 s SP1 | - 30 s SP2 | - 10 s CPAM2 | Tensile index (Nm/g) | Scott Bond (J/m$^2$) |
|---|---|---|---|---|---|---|---|---|
| Test 1-1 (ref.) | 0 | 0 | | | | 0.05 | 34 | 146 |
| Test 1-2 (ref.) | 1 | 1 | | | | 0.05 | 40 | 211 |
| Test 1-3 (ref.) | 1 | 1 | 1.5 | | | 0.05 | 42 | 212 |
| Test 1-4 | 1 | 1 | | | 1.5 | 0.05 | 43 | 227 |

For zeta-potential measurement a 500 ml of test fibre stock was taken to beaker. Cationic chemicals were diluted to 0.2% concentration and anionic chemicals to 0.05% concentration. After addition of cationic chemical(s), if any, fibre stock was mixed for 1 min with spoon before measurement or addition of an anionic chemical. If anionic chemical was added, the fibre stock was mixed for further 1 min with spoon before the measurement. Results of zeta potential measurements are given in Table 9.

TABLE 9

Results of zeta potential measurements.

| # | Added Chemical | | | | | Zeta potential (mV) |
|---|---|---|---|---|---|---|
| | SCPAM (kg/t dry) | Starch-A (kg/t dry) | APAM-1 (kg/t dry) | SP1 (kg/t dry) | SP2 (kg/t dry) | |
| 1 | | | | | | −28 |
| 2 | 1 | 1 | | | | −10 |
| 3 | 1 | 1 | 0.15 | | | −10 |
| 4 | 1 | 1 | 0.3 | | | −17 |
| 5 | 1 | 1 | 0.5 | | | −23 |
| 6 | 1 | 1 | 1 | | | −24 |
| 7 | 1 | 1 | 1.5 | | | −25 |
| 8 | 1 | 1 | | 0.15 | | −15 |
| 9 | 1 | 1 | | 0.3 | | −20 |
| 10 | 1 | 1 | | 0.5 | | −25 |
| 11 | 1 | 1 | | 1 | | −25 |
| 12 | 1 | 1 | | 1.5 | | −27 |
| 13 | 1 | 1 | | | 0.15 | −14 |
| 14 | 1 | 1 | | | 0.3 | −15 |
| 15 | 1 | 1 | | | 0.5 | −22 |
| 16 | 1 | 1 | | | 1 | −23 |
| 17 | 1 | 1 | | | 1.5 | −25 |

The results of zeta potential measurements shown in Table 9 indicate that the dry strength composition SP1 is able to shift very effectively surface charge of fibres towards anionic direction even when the anionicity of the dry strength composition is low.

Application Example 2

This example simulates preparation of printing and writing paper.

Test fibre stock was a mixture of chemical hardwood pulp and softwood pulp. Chemical pulps, which are typical for fine paper, were prepared in Valley Hollander. Hardwood (HW) pulp was bleached birch kraft pulp refined to 25° SR and softwood (SW) pulp was bleached pine kraft pulp refined to 25° SR. Pulps were mixed together in 75%/25% HW/SW ratio, diluted with deionized water containing NaCl addition to 1.5 mS/cm level. Properties of the obtained test fibre stock are given in Table 4.

In hand sheet preparation chemicals were added to the test fibre stock in a dynamic drainage jar under mixing with 1000 rpm. Cationic strength chemicals were diluted before dosing to 0.2% concentration. Anionic chemicals and retention chemicals CPAM and APAM-E were diluted to 0.05% concentration before dosing. The chemicals added and their addition times are given in Table 10. All chemical amounts are given as kg dry chemical per ton dry fibre stock, except APAM-E, which is given as kg emulsion per ton dry fibre stock.

GCC was added to the fibre stock at −25 s from drainage time. Required GCC addition was made to obtain 25% ash content for the produced paper sheets.

Hand sheets having basis weight of 80 g/m$^2$ were formed by using Rapid Kothen sheet former with circulation water in accordance with ISO 5269-2:2012. The sheets were dried in vacuum dryers for 6 minutes at 92° C. and at 1000 mbar. Before testing the laboratory sheets were pre-conditioned for 24 h at 23° C. in 50% relative humidity, according to ISO 187. The measured tensile index and Scott bond values for the prepared hand sheets are given in Table 10.

It can be seen from Table 10 that dry strength composition SP1 is able to generate higher tensile and Scott bond values than conventional anionic strength polymers APAM-1 and APAM-2. Tensile strength is needed, for example, for good runnability of the web in paper machine, as well as for good behaviour in printing and copying processes. Good Scott bond values may be required for offset printing applications.

High Scott bond value can be also used as an indication of reduced dusting tendency of the paper. Typically papermakers wish to maximize the ash content by addition of more filler, but drawback is lowered strength and increased dusting. The obtained Scott bond values indicate that dry strength composition according to the present invention, such as SP1, may be used to allow increase in ash content, i.e. increase in amount of added filler to the fibre stock.

TABLE 10

Hand sheet tests of application example 2: chemical additions and measured results.

| Time | - 60 s GPAM | - 60 s Starch | - 40 s APAM-1 | - 40 s SP1 | - 40 s APAM-2 | -15 s CPAM | - 10 s APAM-E | Tensile index (Nm/g) | Scott Bond (J/m$^2$) |
|---|---|---|---|---|---|---|---|---|---|
| Test 2-1 (ref.) | | | | | | 0.1 | 0.05 | 20.2 | 54 |
| Test 2-2 (ref.) | 2.5 | | | | | 0.1 | 0.05 | 20.0 | 79 |
| Test 2-3 (ref.) | 2.5 | | 0.8 | | | 0.1 | 0.05 | 23.5 | 111 |
| Test 2-4 (ref.) | 2.5 | | 1.6 | | | 0.1 | 0.05 | 22.5 | 99 |

TABLE 10-continued

Hand sheet tests of application example 2: chemical additions and measured results.

| Time | - 60 s GPAM | - 60 s Starch | - 40 s APAM-1 | - 40 s SP1 | - 40 s APAM-2 | -15 s CPAM | - 10 s APAM-E | Tensile index (Nm/g) | Scott Bond ($J/m^2$) |
|---|---|---|---|---|---|---|---|---|---|
| Test 2-5 | 2.5 | | | 0.8 | | 0.1 | 0.05 | 24.7 | 128 |
| Test 2-6 | 2.5 | | | 1.6 | | 0.1 | 0.05 | 28.1 | 157 |
| Test 2-7 (ref.) | 2.5 | | | | 0.8 | 0.1 | 0.05 | 23.7 | 118 |
| Test 2-8 (ref.) | 2.5 | | | | 1.6 | 0.1 | 0.05 | 24.5 | 109 |
| Test 2-9 (ref.) | | 12 | | | | 0.1 | 0.05 | 32.3 | 230 |
| Test 2-10 (ref.) | | 12 | 1.6 | | | 0.1 | 0.05 | 35.3 | 254 |
| Test 2-11 | | 12 | | 1.6 | | 0.1 | 0.05 | 35.9 | 273 |
| Test 2-12 (ref.) | | 12 | | | 1.6 | 0.1 | 0.05 | 33.2 | 251 |

For zeta potential measurement a 500 ml test fibre stock was taken to a beaker. Anionic chemicals were diluted to 0.05% concentration. Fibre stock was mixed for 1 min with spoon before zeta potential measurement (0-Test) or before the addition of an anionic chemical. When anionic chemical was added, the fibre stock was mixed for further 1 min with spoon before the zeta potential measurement. The used chemicals and their amounts are given in Table 11. All chemical amounts are given as kg dry chemical per ton dry fibre stock. Results of zeta potential measurements are also given in Table 11.

The results of zeta potential measurements shown in Table 11 indicate that the dry strength composition SP1 is able to shift very effectively surface charge of fibres towards anionic direction.

TABLE 11

Results of zeta potential measurements in application example 2.

| Chemical | Dosage | Zeta potential (mV) |
|---|---|---|
| 0-test | — | −30 |
| APAM-1 | 0.4 | −30 |
| APAM-1 | 0.8 | −30 |
| APAM-1 | 1.6 | −31 |
| SP1 | 0.4 | −33 |
| SP1 | 0.8 | −34 |
| SP1 | 1.6 | −35 |

Application Example 3

Test fibre stock was a mixture of chemithermo mechanical pulp CTMP and broke. CTMP and broke were mixed in 60% CTMP/40% broke dry ratio. Pulp mixture was diluted to 0.5%. Half of the dilution water volume was white water and half was deionized water with 2 mS/cm conductivity adjusted by NaCl. Properties of the used CTMP, broke and white water are given in Table 4.

In hand sheet preparation chemicals were added to the prepared test fibre stock in a dynamic drainage jar under mixing with 1000 rpm. Cationic strength chemicals were diluted before dosing to 0.2% concentration. Anionic chemicals and retention chemicals were diluted to 0.05% concentration before dosing. The chemicals added and their addition times are given in Table 12. All chemical amounts are given as kg dry chemical per ton dry fibre stock.

Hand sheets having basis weight of 100 $g/m^2$ were formed by using Rapid Kothen sheet former with circulation water in accordance with ISO 5269-2:2012. Handsheet machine dilution water conductivity was adjusted to 2 mS/cm with NaCl. Sheets were wet pressed individually by adding 2 blotting papers on top side and 2 blotting papers on back side. Wet pressing was performed with Lorenz & Wettre sheet press for 1 min with 4 bar pressure adjustment. The sheets were dried in vacuum dryers for 5 minutes at 92° C. and at 1000 mbar. Before testing the laboratory sheets were pre-conditioned for 24 h at 23° C. in 50 relative humidity, according to ISO 187. The measured z-directional tensile and Scott bond values for the prepared hand sheets are given in Table 12.

It can be seen from Table 12 that increased addition of starch together with dry strength composition SP3 provides higher Z-directional tensile strength and Scott bond value for the produced paper. The results obtained with the dry strength composition are also better than the results obtained with conventional two component strength system, which comprises separately added cationic starch and CMC. The strength properties improved with the dry strength composition are beneficial, for example, for middle ply of folding box board. Furthermore, too low Scott bond value leads to problems in printing due to sheet structure splitting.

TABLE 12

Hand sheet test of application example 3: chemical additions and measured results.

| Time | - 55 s Alum (kg/t) | - 50 s pDADMAC (kg/t) | - 40 s Starch-2 (kg/t) | - 35 s CMC (kg/t) | - 30 s SP3 (kg/t) | - 20 s CPAM (kg/t) | - 10 s Silica (kg/t) | Z-dir. Tensile (kPa) | Scott Bond $J/m^2$) |
|---|---|---|---|---|---|---|---|---|---|
| Test 3-1 (ref.) | 1 | 0.2 | 5 | 0 | 0 | 0.2 | 0.075 | 373 | 159 |

TABLE 12-continued

Hand sheet test of application example 3: chemical additions and measured results.

| Time | - 55 s Alum (kg/t) | - 50 s pDADMAC (kg/t) | - 40 s Starch-2 (kg/t) | - 35 s CMC (kg/t) | - 30 s SP3 (kg/t) | - 20 s CPAM (kg/t) | - 10 s Silica (kg/t) | Z-dir. Tensile (kPa) | Scott Bond J/m$^2$) |
|---|---|---|---|---|---|---|---|---|---|
| Test 3-2 (ref.) | 1 | 0.2 | 20 | 2 | 0 | 0.2 | 0.075 | 415 | 181 |
| Test 3-3 | 1 | 0.2 | 20 | 0 | 0.3 | 0.2 | 0.075 | 440 | 192 |

Application Example 4

This example simulates recycled fibre based paper or board manufacturing.

Test fibre stock was made from OCC recycled fibre pulp (OCC=old corrugated cardboard). The OCC pulp was diluted to 1.0%. Half of the dilution water volume was white water and half was deionized water with 4 mS/cm conductivity adjusted by NaCl. The properties of the used OCC pulp and white water are given in Table 4.

In hand sheet preparation chemicals were added to the test fibre stock in a dynamic drainage jar under mixing with 1000 rpm. Cationic strength chemicals were diluted before dosing to 0.2% concentration. Anionic chemicals and retention chemicals were diluted to 0.05% concentration before dosing. The chemicals added and their addition times are given in Table 13. All chemical amounts are given as kg dry chemical per ton dry fibre stock.

Hand sheets having basis weight of 110 g/m$^2$ were formed by using Rapid Kothen sheet former with circulation water in accordance with ISO 5269-2:2012. Hand sheet machine dilution water conductivity was adjusted to 4 mS/cm with 1.76 g/l $CaCl_2$*$2H_2O$ and with NaCl. Ash content of the sheets was adjusted to 8% by controlling retention with CPAM dosage. Required dosage was 0.15 kg/t as average. The sheets were dried in vacuum dryers for 6 minutes at 92° C. and at 1000 mbar. Before testing the laboratory sheets were pre-conditioned for 24 h at 23° C. in 50% relative humidity, according to ISO 187. The measured SCT index and burst index values for the prepared hand sheets are given in Table 13.

It can be seen from Table 13 that SCT index and burst index values can be improved with dry strength composition SP1. Improved SCT index and burst index values are beneficial for liner, fluting and core board grades. Furthermore it can be seen that strength properties obtained with a combination of cationic additive and dry strength composition SP1 are better than strength properties achieved with addition of cationic additive alone.

It should be noted that many OCC based recycled fibre pulps may have a cationic demand and zeta potential close to zero and at the same time high conductivity. This causes a special challenge to the ionic dry strength additives used in the wet end, since the additives are not retained well and/or attached to the fibres. Dry strength composition according to the invention overcomes this problem due to its unique structure and due to high amount of ionic groups.

TABLE 13

Hand sheet tests of application example 4: chemical additions and measured results.

| Time | - 120 s Starch-A | - 120 s SCPAM | - 120 s GPAM | - 60 s SP1 | - 10 s CPAM | SCT index (Nm/g) | Burst index (kpam$^2$/g) |
|---|---|---|---|---|---|---|---|
| Test 4-1 (ref.) | | | | | 0.15 | 21.4 | 1.64 |
| Test 4-2 (ref.) | 1 | 1 | | | 0.15 | 23.1 | 1.97 |
| Test 4-3 | 1 | 1 | | 1.5 | 0.15 | 23.8 | 1.95 |
| Test 4-4 (ref.) | | | 1.5 | | 0.15 | 21.7 | 1.76 |
| Test 4-5 | | | 1.5 | 1.5 | 0.15 | 22.2 | 1.96 |

Application Example 5

In this example manufacturing of folding boxboard and liquid packaging board was simulated with 3-layer sheets made with Formette-dynamic hand sheet former manufactured by Techpap.

A mixture of bleached pine kraft pulp and bleached birch kraft pulp was used in top and back ply furnish. Amount of pine kraft pulp was 35% and bleached birch kraft pulp 65%. Middle ply furnish was bleached CTMP with 440 ml Canadian standard Freeness refining degree. Pulps were disintegrated according to ISO 5263:1995. Kraft pulps were disintegrated at room temperature and CTMP at 85° C. Pulps were diluted to 0.5% consistency with deionized water. Pulps were added to Formette layer-by-layer in order: top, middle, back. Chemical additions were made to mixing tank of Formette according to Table 14. All chemical amounts are given as kg dry chemical per ton dry fibre stock. Water was drained out after all the pulp was sprayed to form a 3-layer web. Drum was operated with 1400 rpm, mixer for pulp 400 rpm, pulp pump 1100 rpm/min, number of sweeps 100 and scoop time was 60 s. Sheet was removed from drum between wire and 1 blotting paper on the other side of the sheet. Wetted blotting paper and wire were removed. Sheet was cut to 15 cm*20 cm size and 3 blotting papers were placed on top side and 3 blotting papers on back side of the sheet before wet pressing in Lorenz & Wettre laboratory wet press. Wet pressing was at 5 bar for 4 min. Sheets were dried 1 blotting paper in top and 1 blotting paper in back of the sheet in restrained condition in a felted steam heated cast iron drum dryer at 92° C. for 3 min. Before testing the laboratory sheets were pre-conditioned for 24 h at 23° C. in 50 relative humidity, according to ISO 187.

TABLE 14

Dynamic hand sheet test program for application example 5.

| | Top/Back layer weight: 35 g/m²/35 g/m² | | | | Middle Layer | | | | |
|---|---|---|---|---|---|---|---|---|---|
| Time | - 50 s Starch | - 40 s SP3 | - 20 s CPAM | - 10 s Silica-2 | Weight (g/m²) | - 60 s pDADMAC | - 50 s Starch | - 40 s SP3 | - 10 s Silica-2 |
| Test 5-1 (ref.) | 5 | | 0.1 | 0.3 | 264 | 0.24 | 5 | | 0.3 |
| Test 5-2 | 12 | 10 | 0.1 | 0.3 | 247 | 0.24 | 20 | 10 | 0.3 |
| Test 5-3 | 12 | 10 | 0.1 | 0.3 | 264 | 0.24 | 20 | 20 | 0.3 |
| Test 5-4 | 12 | 10 | 0.1 | 0.3 | 228 | 0.24 | 20 | 10 | 0.3 |
| Test 5-5 | 12 | 10 | 0.1 | 0.3 | 232 | 0.24 | 20 | 20 | 0.3 |

The measured results for the prepared dynamic hand sheets are given in Table 15. Typically only 5 kg/t of starch has been used for folding boxboard, because high amounts of starch reduce bulk and bending stiffness. It can be seen from Table 15 that higher tensile strength values and bending stiffness can be obtained at same basis weight by addition of dry strength composition SP3 with increased amount of starch, see test 5-1 and test 5-3.

Further it can be seen from Table 15 that the dry strength composition according to the invention increases bending stiffness. Same or higher bending stiffness was obtained with lower basis weight in tests 5-2, 5-4 and 5-5 compared to reference test 5-1. This achievement decreases significantly amount of middle ply furnish and board making costs. Lighter packages can be manufactured for the same end use, which reduces transportation costs and emissions in the life cycle of packaging product.

Furthermore, it can be observed from Table 15 that z-directional tensile and Scott bond values are improved when dry strength composition according to the invention is used. Z-directional tensile and Scott bond are critical for offset-printability of the board. Improvement of these properties can be used to make middle ply furnish even bulkier, as typically higher bulk leads to lower Scott bond or lower z-directional tensile. Increased bulk is beneficial for bending stiffness.

TABLE 15

Dynamic hand sheet test results for application example 5.

| | Basis weight (g/m²) | Tensile index MD (Nm/g) | Tensile index CD (Nm/g) | Tensile stiffness index MD (mNm/kg) | Z-dir. Tensile (kPa) | Scott Bond (J/m²) | Bending stiffness, Taber 15° MD (mNm) |
|---|---|---|---|---|---|---|---|
| Test 5-1 (ref.) | 271 | 23 | 10 | 4.3 | 62 | 40 | 25 |
| Test 5-2 | 254 | 29 | 17 | 5.4 | 82 | 82 | 43 |
| Test 5-3 | 271 | 28 | 15 | 4.6 | 97 | 52 | 42 |
| Test 5-4 | 235 | 34 | 16 | 5.6 | 129 | 72 | 34 |
| Test 5-5 | 239 | 37 | 17 | 5.7 | 120 | 75 | 36 |

Application Example 6

This example simulates preparation of multi-ply board, such as folding box board or liquid packaging board. Test sheets were made with Formette-dynamic hand sheet former manufactured by Techpap.

Test fibre stock was made from 80% of bleached dried CTMP having Canadian standard Freeness of 580 ml and 20% of dry base paper broke from manufacture of folding box board. Test pulp was disintegrated according to ISO 5263:1995, at 80° C. Test fibre stock was diluted to 0.6% consistency with deionized water, pH was adjusted to 7, and NaCl salt was added to obtain conductivity of 1.5 mS/cm.

Dry strength composition SP4 was made by mixing 50 weight-% of Starch-A and 50 weight-% of AC11HM. For properties, see Table 1. Reference dry strength composition SPC with cationic net charge was made by mixing 50 weight-% of Starch-A and 50 weight-% of SCPAM, and it had viscosity of 4500 mPas, pH 4.0, charge of 0.78 meq/g at pH 7, charge of 0.28 meq/g at pH 2.8, and dry solids content of 14 weight-%.

In the test the dry strength composition, either SP4 or SPC, was added after a cationic strength agent, which was cationic starch (Starch-1). Retention polymer used was CPAM-2.

Pulp mixture was added to Formette. Chemical additions were made to mixing tank of Formette according to Table 16. All chemical amounts are given as kg dry chemical per ton dry fibre stock. Water was drained out after all the pulp was sprayed. Drum was operated with 1400 rpm, mixer for pulp 400 rpm, pulp pump 1100 rpm/min, number of sweeps 100 and scoop time was 60 s. Sheet was removed from drum between wire and 1 blotting paper on the other side of the sheet. Wetted blotting paper and wire were removed. Sheets were wet pressed at Techpap nip press with 5 bar pressure with 2 passes having new blotting paper each side of the sheet before each pass. Sheets were cut to 15 cm*20 cm size. Sheets were dried in restrained condition in STFI restrained dryers. Before testing in the laboratory sheets were pre-conditioned for 24 h at 23° C. in 50% relative humidity, according to ISO 187.

TABLE 16

Dynamic hand sheet test program for application example 6.

| Test | Time - 60 s Starch-1 (kg/t) | - 30 s SP4 (kg/t) | - 30 s SPC (kg/t) | - 15 s CPAM-2 (kg/t) |
|---|---|---|---|---|
| Test 6-1 (ref.) | | | | 0.15 |
| Test 6-2 (ref.) | 15 | | | 0.15 |
| Test 6-3 | 15 | 1.2 | | 0.15 |
| Test 6-4 | 15 | 2.4 | | 0.15 |
| Test 6-5 (ref.) | 15 | | 1.2 | 0.15 |
| Test 6-6 (ref.) | 15 | | 2.4 | 0.15 |

Z-directional tensile and elastic modulus in machine direction (MD) and in cross direction (CD) analysed with tensile strength test were measured according to methods in table 6.

Table 17 presents the measurement results. Addition of cationic starch only reduced press solids, whereas the addition of dry anionic strength composition SP4 improved press solids. Z-directional tensile and elastic modulus are important strength properties for folding box board and liquid packaging board manufacturing. Tests 6-3 and 6-4 with strength composition SP4 showed higher Z-directional tensile and higher elastic modulus values than tests 6-5 and 6-6 where cationic dry strength composition SPC was used.

TABLE 17

Measurement results of solids after wet pressing, Z-directional tensile (ZDT) and Elastic modulus (E-mod) for application example 6.

| | Press solids (%) | ZDT (kPa) | E-mod CD (GPa) | E-mod MD (GPa) |
|---|---|---|---|---|
| Test 6-1 (ref.) | 37 | 101 | 0.19 | 214 |
| Test 6-2 (ref.) | 35 | 225 | 0.23 | 2.39 |
| Test 6-3 | 40 | 240 | 0.23 | 2.38 |
| Test 6-4 | 38 | 260 | 0.24 | 2.44 |
| Test 6-5 (ref.) | | 239 | 0.22 | 2.37 |
| Test 6-6 (ref.) | | 233 | 0.22 | 2.34 |

Application Example 7

This example simulates preparation of multi-ply board containing recycled fibres.

Dry strength composition SP4 was same as in Example 6 and dry strength composition SP5 was made by mixing 69 weight-% of Starch-A and 31 weight-% of AC11HM. For properties, see Table 1. Cationic dry strength composition SPC was the same as in Example 6.

Test pulp was thick stock from board machine consisting 70% DIP made from old magazines and 30% BCTMP long fibre bale pulp slushed in pulper. Pulp was diluted with board mill clear filtrate to 1% consistency. Conductivity of the diluted test pulp was 2.2 mS/cm.

In hand sheet preparation chemicals were added to the prepared test fibre stock in a dynamic drainage jar under mixing with 1000 rpm. Cationic strength chemicals were diluted before dosing to 0.2% concentration. Anionic chemicals and retention chemicals were diluted to 0.05% concentration before dosing. The chemicals added and their addition times are given in Table 18. All chemical amounts are given as kg dry chemical per ton dry fibre stock. Retention polymer dosage was adjusted to keep retention and basis weight constant in the hand sheets.

Hand sheets having basis weight of 100 g/m$^2$ were formed by using Rapid Kothen sheet former in accordance with ISO 5269-2:2012. Handsheet machine dilution water conductivity was adjusted to 2.2 mS/cm with NaCl. Sheets were wet pressed individually by adding 2 blotting papers on top side and 2 blotting papers on back side. Wet pressing was performed with Lorenz & Wettre sheet press for 1 min with 4 bar pressure adjustment. The sheets were dried in vacuum dryers for 5 minutes at 92° C. and at 1000 mbar. Before testing the laboratory sheets were pre-conditioned for 24 h at 23° C. in 50% relative humidity, according to ISO 187. The measured changes in tensile index, burst index and Z-directional tensile are given in Table 18. The change is given as increase in percentage values, calculated between each individual test point and 0-test (test 7-1). All test points contained 6 ash in the sheet.

It is seen from Table 18 that anionic dry strength composition SP4 improved tensile, burst and Z-directional tensile when used together with cationic dry strength composition SPC. Strength composition SP5 with low anionicity, tests 7-5 & 7-6, improved strength properties in comparison to 0-test 7-1 without any addition of dry strength compositions. Burst strength improvement, which is achieved with SP4 and SP5, is comparable with the result achieved with a cationic dry strength composition SPC in test 7-2. Tests 7-3 and 7-4 indicate that the dry strength composition according to the invention provides improved tensile properties especially when it is used together with a cationic strength agent.

TABLE 18

Hand sheet tests of application example 7: chemical additions and measured results.

| Time | - 60 s SPC | - 30 s SP4 | - 30 s SP5 | - 10 s CPAM-2 | Tensile index (%) | Burst index (%) | Z-dir. tensile (%) |
|---|---|---|---|---|---|---|---|
| Test 7-1 (ref.) | | | | 0.2 | 0 | 0 | 0 |
| Test 7-2 (ref.) | 3 | | | 0.1 | 7 | 10 | 18 |
| Test 7-3 | 3 | 1 | | 0.1 | 9 | 11 | 20 |
| Test 7-4 | 3 | 2 | | 0.1 | 21 | 12 | 19 |
| Test 7-5 | | | 2 | 0.1 | 2 | 7 | 10 |
| Test 7-6 | | | 3.5 | 0.1 | 2 | 10 | 13 |

Application Example 8

This example simulates preparation of multi-ply board such as folding box board or liquid packaging board with Formette-dynamic hand sheet former manufactured by Techpap. Dry strength compositions SP4 and SP6 are used.

Test fibre stock was made from bleached dried chemithermomechanical pulp CTMP having Canadian standard Freeness of 580 ml and dry base paper broke from manufacture of folding box board. CTMP and broke were mixed in 80% CTMP/20% broke dry ratio. Pulps were disintegrated according to ISO 5263:1995, at 80° C. Pulp mixture was diluted to 0.6% consistency with deionized water, its pH was adjusted to 7 and NaCl was added to obtain conductivity level of 1.5 mS/cm.

Pulp mixture was added to Formette and the sheets were prepared, pressed and cut in the same manner than in Application Example 6. Chemical additions were made to the mixing tank of Formette according to Table 19. Retention polymer was CPAM-2. All chemical amounts are given as kg dry chemical per ton dry fibre stock. Sheets were dried in restrained condition in a drum dryer at 92° C. first pass with blotting paper and second pass without. Drying time was 1 min/pass. Before testing in the laboratory the sheets were pre-conditioned for 24 h at 23° C. in 50% relative humidity, according to ISO 187.

Z-directional tensile and tensile strength (MD) were measured according to methods in table 6.

TABLE 19

Hand sheet tests of application example 8: chemical additions and measured results.

| Time | - 60 s Starch-1 | - 30 s SP4 | - 30 s SP6 | - 10 s CPAM-2 | Press solids (%) | Z-dir. Tensile (kPa) | Tensile index MD (Nm/g) |
|---|---|---|---|---|---|---|---|
| Test 8-1 | | | | 0.05 | 37 | 104 | 28 |
| Test 8-2 | 15 | | | 0.05 | 40 | 175 | 35 |
| Test 8-3 | 15 | 1.2 | | 0.05 | 43 | 223 | 38 |
| Test 8-4 | 15 | 2.4 | | 0.05 | 43 | 203 | 40 |
| Test 8-5 | 15 | | 1.2 | 0.05 | 38 | 183 | 38 |
| Test 8-6 | 15 | | 2.4 | 0.05 | 38 | 186 | 38 |

The results of Application Example 8 are shown also in Table 19. The obtained results indicate that the molecular weight of the anionic synthetic polymer component has an impact on the performance of the dry strength composition. When the polymer component had a higher molecular weight (test 8-3, 8-4) an improvement in press solids, Z-directional tensile and in tensile strength could be observed. The obtained effect is greater than in tests 8-5 & 8-6 where the synthetic polymer component ha a lower molecular weight of about 500 000 g/mol. This behaviour indicates that molecular weight of anionic synthetic polymer component may affect the charge distribution on the surface of the formed complex with the cationic starch component.

Application Example 9

This example simulates preparation of multi-ply board, such as folding box board or liquid packaging board, with Formette-dynamic hand sheet former manufactured by Techpap.

In Application Example 9 dry strength composition SP4 was used with cationic strength agent polyvinylalcohol c-PVOH.

Test fibre stock was made from bleached dried chemithermomechanical pulp CTMP having Canadian standard Freeness of 580 ml and dry base paper broke of folding box board. CTMP and broke were mixed in 80% CTMP/20% broke dry ratio. Pulps were disintegrated according to ISO 5263:1995, at 80° C. Pulp mixture was diluted to 0.6% consistency with deionized water, its pH was adjusted to 7 and NaCl was added to obtain conductivity level of 1.5 mS/cm.

Pulp mixture was added to Formette and the sheets were prepared, pressed and cut in the same manner than in Application Example 6, except the drum was operated with 800 rpm. Chemical additions were made to the mixing tank of Formette according to Table 20. Retention polymer was CPAM-2. All chemical amounts are given as kg dry chemical per ton dry fibre stock. Sheets were dried in restrained condition in a drum dryer at 92° C. first pass with blotting paper and second pass without. Drying time was 1 min/pass. Before testing in the laboratory the sheets were pre-conditioned for 24 h at 23° C. in 50% relative humidity, according to ISO 187.

TABLE 20

Dynamic hand sheet test program for application example 9.

| Time | - 60 s c-PVOH | - 30 s SP4 | - 20 s c-PVOH | - 10 s CPAM-2 | Z-dir. Tensile (kPa) | Tensile index MD (Nm/g) |
|---|---|---|---|---|---|---|
| Test 9-1 | | | | 0.05 | 97 | 17 |
| Test 9-2 | 0.5 | | | 0.05 | 140 | 24 |
| Test 9-3 | 0.5 | 2.4 | | 0.05 | 154 | 27 |
| Test 9-4 | | 2.4 | 0.5 | 0.05 | 145 | 29 |

The results in Table 20 show surprisingly that irrespective of the addition order of the dry strength composition SP4 and cationic strength agent c-PVOH, the strength properties of the final sheet were improved. Addition of the cationic strength agent c-PVOH first provided an improvement in Z-directional tensile value, whereas addition of anionic dry strength composition SP4 first provided an improvement in tensile index. This creates valuable opportunities in the manufacture of different paper and board grades, since the strength requirements vary between the various grades. Sometimes good strength properties are desired in MD direction and sometimes in Z-direction. The dry strength composition SP4 according to the present invention also provided the surprising effect that the strength performance was good even with a low dosage of cationic strength agent c-PVOH. Typically cationic strength agents are dosed relatively larger amounts, more than 1 kg/t.

Even if the invention was described with reference to what at present seems to be the most practical and preferred embodiments, it is appreciated that the invention shall not be limited to the embodiments described above, but the invention is intended to cover also different modifications and equivalent technical solutions within the scope of the enclosed claims.

The invention claimed is:

1. An aqueous dry strength composition suitable for use in manufacture of paper, board or the like, which composition comprising a mixture of:

a synthetic polymer component, which is a copolymer of acrylamide and at least one anionic monomer, the polymer component having an anionicity of 1-60 mol-%, and a cationic starch component, the synthetic polymer component and the cationic starch component providing the composition with a charge density in a range of:

0.05-1 meq/g, when measured at pH 2.8, and

−0.2--3 meq/g, when measured at pH 7.0.

2. The composition according to claim 1, wherein the cationic starch component has an amylopectin content >80%.

3. The composition according to claim 1, wherein that the synthetic polymer component and cationic starch component provide a charge density in a range of:

0.1-0.5 meq/g, when measured at pH 2.8, and

−0.4--2.0 meq/g, when measured at pH 7.0.

4. The composition according to claim 1, wherein the dry strength composition has anionic net charge already at pH 5.5.

5. The composition according to claim 1, wherein the dry strength composition comprises 10-90 weight-% of the synthetic polymeric component, and 10-90 weight-% of the cationic starch component.

6. The composition according to claim 1, wherein the cationic starch component has a substitution degree of 0.025-0.3.

7. The composition according to claim 1, wherein the cationic starch component is non-degraded starch.

8. The composition according to claim 1, wherein the synthetic polymer component is prepared by polymerization, of acrylamide and at least one anionic monomer, which is selected from unsaturated mono- or dicarboxylic acids.

9. The composition according to claim 1, wherein the synthetic polymer component has an anionicity of 3-40 mol-%.

10. The composition according to claim 1, wherein the synthetic polymer component has a weight average molecular weight MW in a range of 300 000-1 000 000 g/mol.

11. The composition according to claim 1, wherein the dry strength composition is free of cationic synthetic polymers.

12. The composition according to claim 1, wherein the dry strength composition has a Brookfield viscosity of <10 000 mPas, at solids content of 14 weight-% and at pH 3.0.

13. A method for making of paper, board or the like, comprising:

obtaining a fibre stock having a pH value, adding a cationic strength agent to the fibre stock, diluting a dry strength composition according to claim 1 with water to obtain a solution of the dry strength composition having an end pH >3, and adding the solution of the dry strength composition to the fibre stock before or after the addition of the cationic strength agent.

14. The method according to claim 13, wherein the fibre stock comprises recycled fibres and/or chemical pulp, and/or the fibre stock has a conductivity of at least 2 mS/cm.

15. The method according to claim 13, wherein adding the dry strength composition is done in an amount of 0.5-4.0 kg/ton dry fibre stock.

16. The method according to claim 13, wherein adding the cationic strength agent and the dry strength composition is done, in such amount, that the number of excess anionic charges in the dry strength composition, at pH 7, is 20-200%, of the total number of cationic charges of the cationic strength agent.

17. The method according to claim 13, wherein the cationic strength agent is selected from a group of cationic starch, polyamidoamine-epichlorohydrin, cationic polymers of acrylamide, and polyvinylamines.

18. The method according to claim 13, wherein preparing the dry strength composition is done on-site.

19. The method according to claim 13, wherein the cationic strength agent is cationic starch, which is of identical botanic origin as the cationic starch component of the dry strength composition.

20. The method according to claim 13, wherein adding the dry strength composition is done after the cationic strength agent.

21. The method according to claim 13, wherein the fibre stock has a pH value at least 4.5, wherein the dry strength composition has an anionic net charge at the pH of the fibre stock.

* * * * *